US010338497B2

(12) United States Patent
Huang

(10) Patent No.: US 10,338,497 B2
(45) Date of Patent: Jul. 2, 2019

(54) DELIVERY NOZZLE RECEIVING DEVICE AND TONER CARTRIDGE

(71) Applicant: Shih-Chieh Huang, Zhuhai (CN)

(72) Inventor: Shih-Chieh Huang, Zhuhai (CN)

(73) Assignee: THANSPEX IMAGE TECHNOLOGY CO., LTD., Zhuhai (CN)

( * ) Notice: Subject to any disclaimer, the term of this patent is extended or adjusted under 35 U.S.C. 154(b) by 0 days.

(21) Appl. No.: 15/962,707

(22) Filed: Apr. 25, 2018

(65) Prior Publication Data

US 2019/0129330 A1 May 2, 2019

(30) Foreign Application Priority Data

Nov. 1, 2017 (CN) ..... 2017 1 1057696

(51) Int. Cl.
*G03G 15/08* (2006.01)
*G03G 21/16* (2006.01)

(52) U.S. Cl.
CPC ..... *G03G 15/0867* (2013.01); *G03G 15/0891* (2013.01); *G03G 21/1633* (2013.01)

(58) Field of Classification Search
CPC ..... G03G 15/0886; G03G 15/0872; G03G 2215/0692
See application file for complete search history.

(56) References Cited

U.S. PATENT DOCUMENTS

| | | | | |
|---|---|---|---|---|
| 5,481,344 | A * | 1/1996 | Yasuda | G03G 15/087 222/DIG. 1 |
| 9,448,507 | B2 * | 9/2016 | Suzuki | G03G 15/0886 |
| 9,454,099 | B2 * | 9/2016 | Yamabe | G03G 15/0872 |
| 9,465,317 | B2 * | 10/2016 | Kikuchi | G03G 15/0877 |
| 2015/0338775 | A1 * | 11/2015 | Hosokawa | G03G 15/0868 399/258 |

* cited by examiner

*Primary Examiner* — Clayton E. LaBalle
*Assistant Examiner* — Leon W Rhodes, Jr.
(74) *Attorney, Agent, or Firm* — Cozen O'Connor

(57) ABSTRACT

A toner cartridge and a delivery nozzle receiving device, the latter includes a fixture bracket, a closer, and an elastic element. A guiding slot is formed in the fixture bracket along a length direction of the fixture bracket, and one end of the guiding slot is provided with a delivery nozzle receiving opening. The closer is mounted inside the fixture bracket and can move along the guiding slot between a closed location and an opened location. The elastic element is sleeved outside the fixture bracket and pushes the closer towards the closed location, a first end of the elastic element is limited on an end of the fixture bracket close to the delivery nozzle receiving opening, and a second end of the elastic element is connected to an end of the closer away from the delivery nozzle receiving opening.

3 Claims, 10 Drawing Sheets

DELIVERY NOZZLE RECEIVING DEVICE AND TONER CARTRIDGE

BACKGROUND OF THE INVENTION

1. Field of the Invention

The present invention relates to the field of printing supplies, and more particularly, to a delivery nozzle receiving device and a toner cartridge.

2. Description of the Related Art

An electrophotographic imaging device generally includes an image processing unit and a developing unit. Developer, for example, toner, provided by the developing unit is used to develop an electrostatic latent image formed on the image processing unit, to form a visible image on a medium such as a paper. As consumables, the toner needs to be constantly supplied to the electrophotographic imaging device. Usually, a toner container detachably mounted onto the developing unit in the electrophotographic imaging device and containing a particular amount of toner is used to provide toner for the developing unit.

Referring to FIG. 1, known or existing toner cartridge includes a cylinder body 11, a delivery nozzle receiving device 12 fixed inside an axial end of the cylinder body 11, and a side cover 13 and an outer cover 14 buckled outside the axial end of the cylinder body 11. The cylinder body 11 passes through the side cover 13 and is fixed to the outer cover 14 by screw thread. The delivery nozzle receiving device 12 includes a closer 121, a fixture bracket 122, and a spring 123. The fixture bracket 122 extends towards the inside of the cylinder body 11 along an axial direction of the cylinder body 11, and a guiding slot 1221 is formed in the fixture bracket 122 along a length direction of the fixture bracket 122. One end of the guiding slot 1221 is provided with a delivery nozzle receiving opening 1222, and the closer 121 is mounted inside the fixture bracket 122 and can move along the guiding slot 1221 between a closed location at which the delivery nozzle receiving opening 1222 is closed and an opened location at which the delivery nozzle receiving opening 1222 is opened. The spring 123 is sleeved on the closer 121, one end of the spring abuts against an end wall of the fixture bracket 122, and the other end of the spring abuts against an end wall of the closer 121. The outer cover 14 is in threaded connection to the cylinder body 11 and covers the delivery nozzle receiving opening 1222.

Referring to FIG. 2 to FIG. 4, during mounting of the existing toner cartridge, the outer cover 14 is removed, the closer 121 of the toner cartridge is aligned with a delivery nozzle 10 on the electrophotographic imaging device, and during a process of pushing the toner cartridge forward, the delivery nozzle 10 pushes the closer 121 backwards, the closer 121 moves towards the inside of the toner cartridge, to open the delivery nozzle receiving opening 1222, and toner in the toner cartridge enters the electrophotographic imaging device through a toner inlet 101 of the delivery nozzle 10.

The existing toner cartridge can deliver only toner having good fluidity, and if toner having poor fluidity is used, a case of insufficient toner supply easily occurs, affecting normal working of the electrophotographic imaging device. In addition, the spring 123 of the existing toner cartridge is disposed inside the fixture bracket 122, which does not facilitate replacement.

In addition, before the existing toner cartridge is mounted onto a printer, the closer 121 abuts against an external port of the fixture bracket 122 under elastic force of the spring 123, and if the spring 123 has small elastic force, the closer 121 possibly may move towards the inside of the existing toner cartridge when the existing toner cartridge vibrates or shakes during transportation, and further, a case of toner leakage occurs. Therefore, a spring 123 having large elastic force needs to be used. However, when the spring 123 has large elastic force, a user needs to push the existing toner cartridge into the printer with a large force when mounting the existing toner cartridge onto the printer, leading to hand discomfort during mounting of the toner cartridge.

SUMMARY OF THE INVENTION

A main objective of the present invention is to provide a delivery nozzle receiving device that is compatible with different types of toner and can prevent toner leakage.

Another objective of the present invention is to provide a toner cartridge having the delivery nozzle receiving device.

To implement the foregoing main objective, the present invention provides a delivery nozzle receiving device, including a fixture bracket, a closer, and an elastic element. A guiding slot is formed in the fixture bracket along a length direction of the fixture bracket, and one end of the guiding slot is provided with a delivery nozzle receiving opening. The closer is mounted inside the fixture bracket and can move along the guiding slot between a closed location at which the delivery nozzle receiving opening is closed and an opened location at which the delivery nozzle receiving opening is opened. The elastic element is sleeved outside the fixture bracket and pushes the closer towards the closed location, a first end of the elastic element is limited on an end of the fixture bracket close to the delivery nozzle receiving opening, and a second end of the elastic element is connected to an end of the closer away from the delivery nozzle receiving opening.

As can be seen from the foregoing solution, after thrust force is exerted on the closer, the closer moves in a direction away from the delivery nozzle receiving opening relative to the cylinder body, to open the delivery nozzle receiving opening, and the elastic element is stretched under the thrust force of the closer and pushes the closer in a direction of closing the delivery nozzle receiving opening. After the thrust force exerted on the closer is cancelled, under elastic restoring force of the elastic element, the closer moves in a direction close to the delivery nozzle receiving opening relative to the cylinder body, to close the delivery nozzle receiving opening. The elastic element can be replaced according to requirements.

In a preferable solution, the elastic element is a tension spring, a first end of the tension spring is fixed to the end of the fixture bracket close to the delivery nozzle receiving opening, and a second end of the tension spring is connected to the end of the closer away from the delivery nozzle receiving opening.

As can be seen, the tension spring has a simple structure and is easy to fix and mount.

In a preferable solution, a non-circular hole is formed in an end portion of the fixture bracket away from the delivery nozzle receiving opening, and the closer is in clearance fit with the non-circular hole and moves along the non-circular hole in an axial direction of the fixture bracket.

As can be seen, it is ensured that the closer and the fixture bracket cannot rotate relatively in a circumferential direction of the fixture bracket.

To implement the another objective, the present invention provides a toner cartridge, including a cylinder body used for accommodating developer and a delivery nozzle receiving device disposed on a first axial end of the cylinder body. The delivery nozzle receiving device includes a fixture bracket, a closer, and an elastic element. The fixture bracket is fixed to the first axial end of the cylinder body and is located inside the cylinder body. A guiding slot is formed in the fixture bracket along a length direction of the fixture bracket, the guiding slot is communicated with the inside of the cylinder body, and a side of the guiding slot close to the first axial end of the cylinder body is provided with a delivery nozzle receiving opening. The closer is mounted inside the fixture bracket and can move along the guiding slot between a closed location at which the delivery nozzle receiving opening is closed and an opened location at which the delivery nozzle receiving opening is opened. The elastic element is sleeved outside the fixture bracket and pushes the closer towards the closed location, a first end of the elastic element is limited on an end of the fixture bracket close to the delivery nozzle receiving opening, and a second end of the elastic element is connected to an end of the closer away from the delivery nozzle receiving opening.

As can be seen from the foregoing solution, during mounting of the toner cartridge, the closer is aligned with a delivery nozzle of an electrophotographic imaging device, the toner cartridge is pushed forward, the delivery nozzle pushes the closer backwards, and the closer moves towards the inside of the toner cartridge relative to the cylinder body, to open the delivery nozzle receiving opening. The elastic element is stretched under thrust force of the closer and pushes the closer in a direction of closing the delivery nozzle receiving opening. When the toner cartridge is taken out from the electrophotographic imaging device, the thrust force exerted by the delivery nozzle on the closer is cancelled, and under elastic restoring force of the elastic element, the closer moves in a direction close to the delivery nozzle receiving opening relative to the cylinder body, to close the delivery nozzle receiving opening. The elastic element can be replaced according to requirements of performance of toner such as fluidity.

In a preferable solution, the elastic element is a tension spring, a first end of the tension spring is fixed to the end of the fixture bracket close to the delivery nozzle receiving opening, and a second end of the tension spring is connected to the end of the closer away from the delivery nozzle receiving opening of the cartridge.

As can be seen, the tension spring has a simple structure and is easy to fix and mount.

In a preferable solution, a conveying component is disposed on the cylinder body, the conveying component is a helical protrusion that projects from an inner peripheral wall of the cylinder body in a helical manner, and the conveying component conveys the developer in a first conveying direction from an inner side of the cylinder body to the delivery nozzle receiving opening; and a direction of turning of the tension spring is the same as or opposite to a direction of turning of the helical protrusion.

As can be seen, the conveying component is disposed, so that it is ensured that toner in the cylinder body can be smoothly conveyed to the delivery nozzle receiving opening.

In a further solution, the direction of turning of the tension spring is the same as the direction of turning of the helical protrusion, and the tension spring conveys the developer in the first conveying direction.

As can be seen, when the direction of turning of the tension spring is the same as the direction of turning of the helical protrusion, the tension spring can convey the developer in the first conveying direction from the inner side of the cylinder body to the delivery nozzle receiving opening, to increase a toner feeding amount. This is applicable to toner with poor fluidity.

In a further solution, the direction of turning of the tension spring is opposite to the direction of turning of the helical protrusion, and the tension spring conveys the developer in a second conveying direction from the delivery nozzle receiving opening to the inner side of the cylinder body.

As can be seen, when the direction of turning of the tension spring is opposite to the direction of turning of the helical protrusion, the tension spring can convey the developer in a direction away from the delivery nozzle receiving opening, so that the developer is prevented from blocking a toner inlet of the delivery nozzle. This is applicable to toner with good fluidity.

In a preferable solution, the toner cartridge further includes an outer cover. The outer cover is mounted on the first axial end of the cylinder body, the closer is in threaded connection to the outer cover, and the fixture bracket and the closer are fixed in a circumferential direction of the fixture bracket.

As can be seen, the closer and the cylinder body both are fixedly connected to the outer cover. Therefore, when collision occurs on the toner cartridge during transportation, toner leakage caused by the movement of the closer towards the inside of the toner cartridge can be prevented.

In a preferable solution, a toner feeding opening is formed in a second axial end of the cylinder body, and a toner feeding opening cover is disposed on the toner feeding opening.

As can be seen, when the toner in the toner cartridge is used up, toner can be filled into the toner cartridge through the toner feeding opening, thereby implementing recycling use of the toner cartridge.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

DETAILED DESCRIPTION OF THE PRESENTLY PREFERRED EMBODIMENTS

The following further describes the present invention with reference to the accompanying drawings and embodiments.

Figure 1:
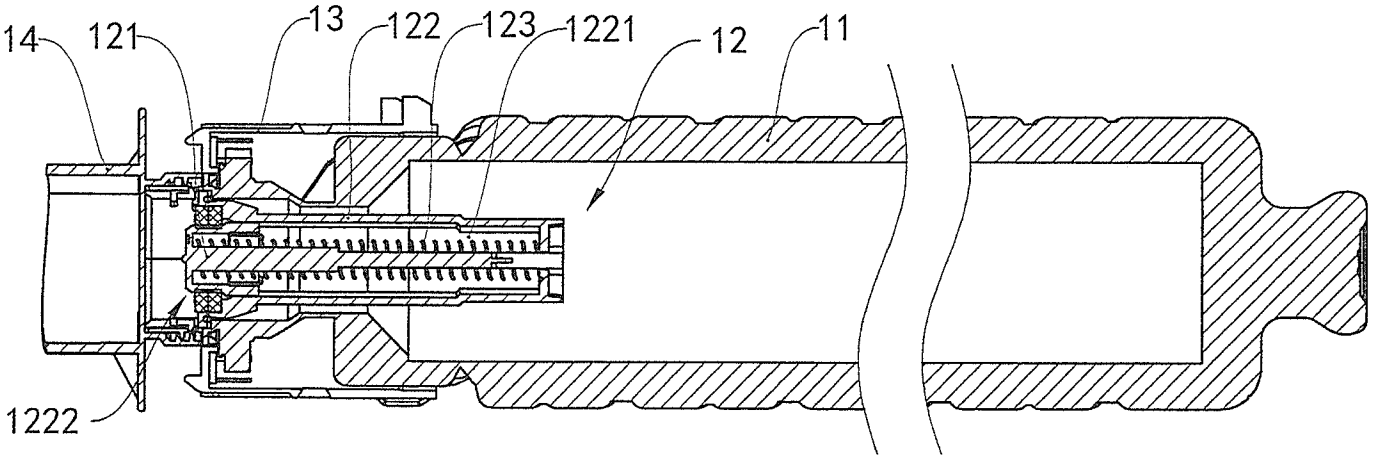
(Prior Art) Fig.1
FIG. 1 is a section view of a prior art toner cartridge.
Figure 2:
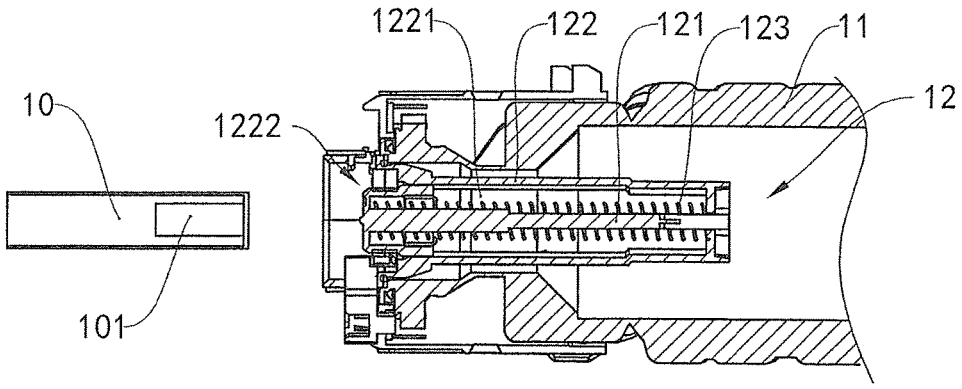
(Prior Art) Fig.2
FIG. 2 is a section view before a prior art toner cartridge is connected to an electrophotographic imaging device.
Figure 3:
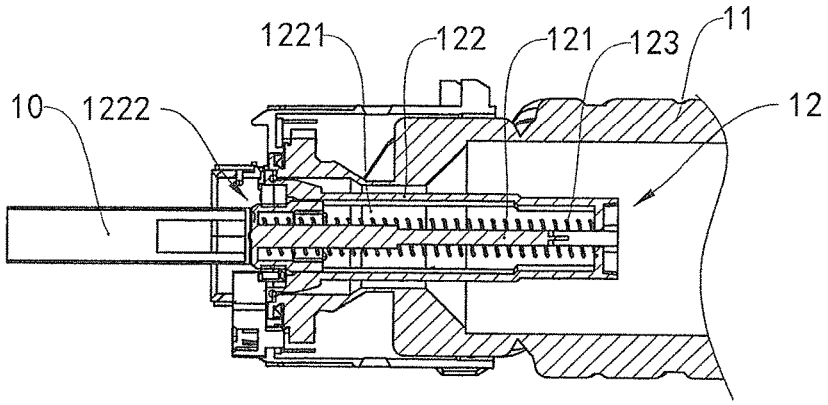
(Prior Art) Fig.3
FIG. 3 is a section view in a process of connecting a prior art toner cartridge to an electrophotographic imaging device.
Figure 4:
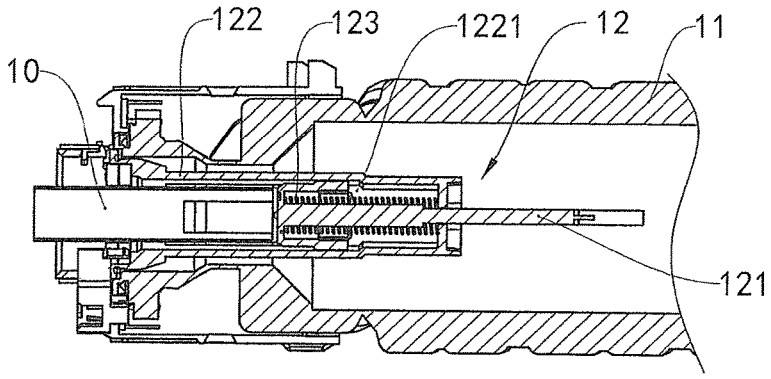
(Prior Art) Fig.4
FIG. 4 is a section view after a prior art toner cartridge is connected to an electrophotographic imaging device.
Figure 5:
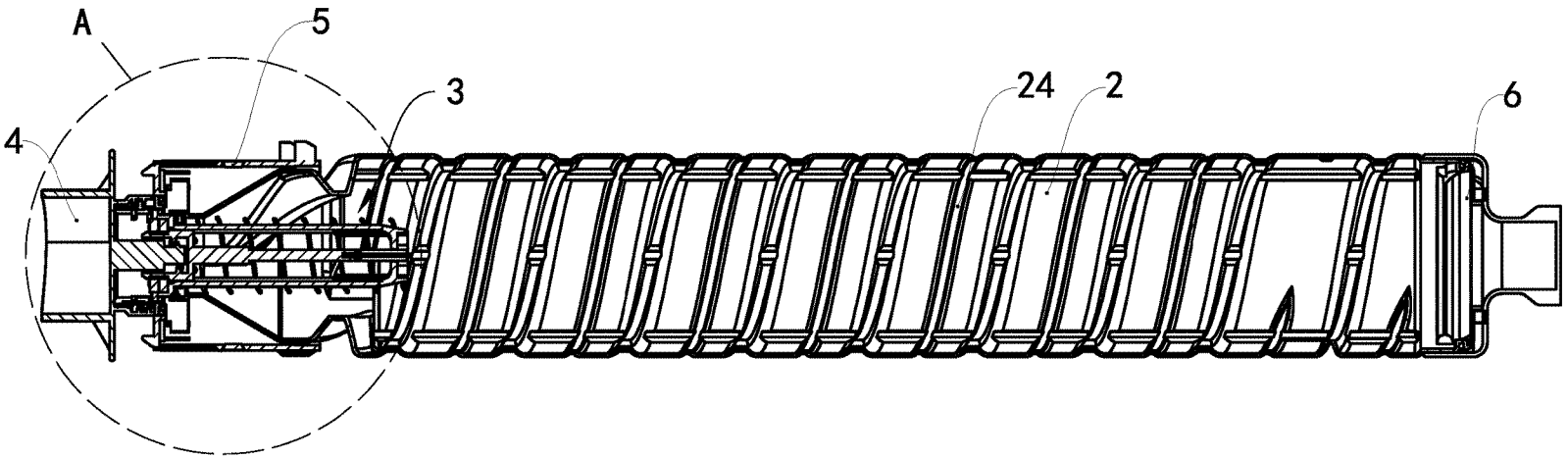
FIG. 5 is a section view of a toner cartridge according to an embodiment of the present invention.
Figure 6:
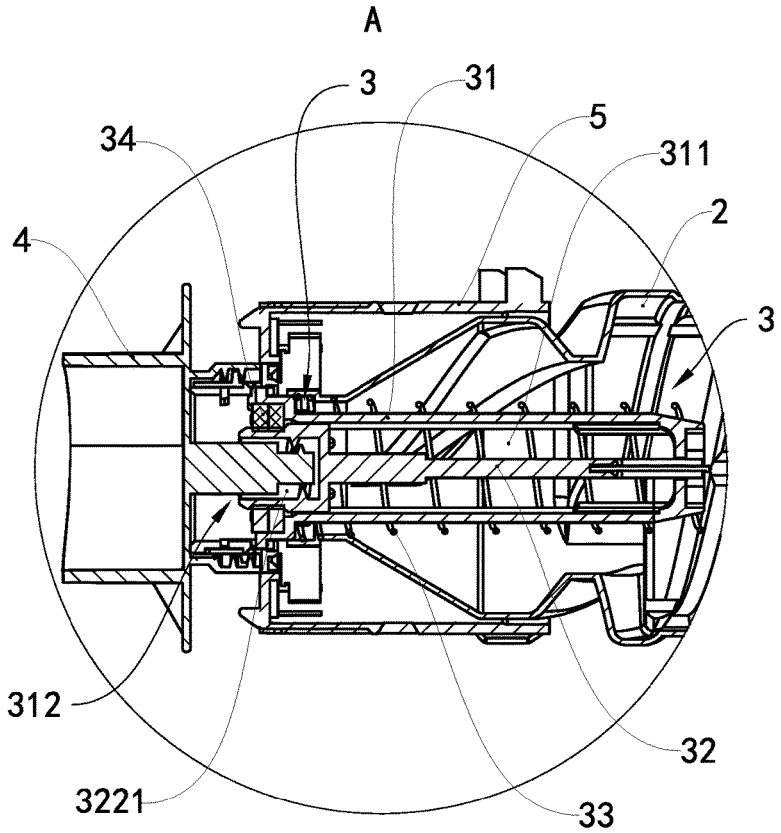
FIG. 6 is a partial enlargement view of portion A in FIG. 5.

Referring to FIG. 5, a toner cartridge in an embodiment includes a cylinder body 2, a delivery nozzle receiving device 3, a side cover 5, an outer cover 4, and a toner feeding opening cover 6.

Figure 7:
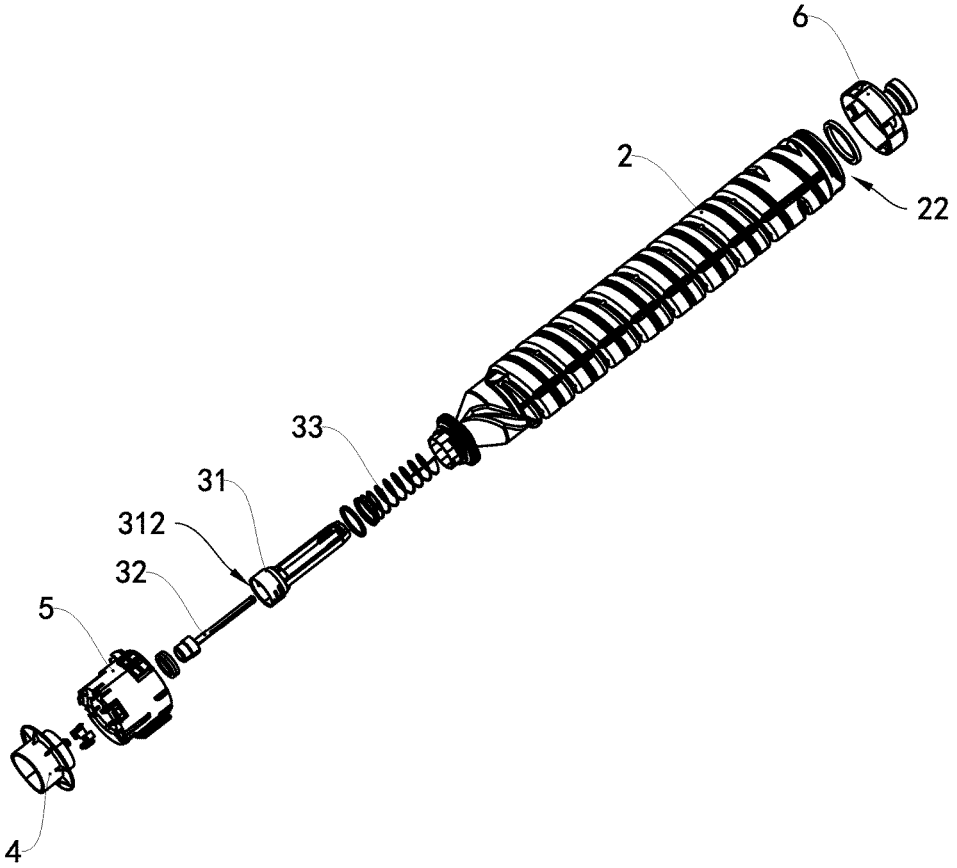
FIG. 7 is an exploded structural view of a toner cartridge according to an embodiment of the present invention.

The cylinder body 2 is used for accommodating developer. The delivery nozzle receiving device 3, the side cover 5, and the outer cover 4 all are disposed on a first axial end of the cylinder body 2, the side cover 5 is located between the outer cover 4 and the cylinder body 2, the side cover 5 is buckled on the cylinder body 2, and the side cover 5 and the cylinder body 2 are detachably fixed by using a buckle. A toner feeding opening 22 (shown in FIG. 7) is formed in a second axial end of the cylinder body 2, and the toner feeding opening cover 6 is mounted on the toner feeding opening 22. A conveying component 24 is disposed on the cylinder body 2, and the conveying component 24 is a helical protrusion that projects from an inner peripheral wall of the cylinder body 2 in a helical manner. A direction of turning of the helical protrusion is clockwise. The conveying component 24 conveys the developer in a first conveying direction from an inner side of the cylinder body 2 to the delivery nozzle receiving device 3.

Referring to FIG. 6 to FIG. 10, the delivery nozzle receiving device 3 includes a fixture bracket 31, a closer 32, an elastic element, and a seal 34. The fixture bracket 31 is fixed to the first axial end of the cylinder body 2 and is located inside the cylinder body 2. A guiding slot 311 is formed in the fixture bracket 31 along a length direction of the fixture bracket 31, the guiding slot 311 is communicated with the inside of the cylinder body 2, and a delivery nozzle receiving opening 312 is disposed at a side of the guiding slot 311 close to the first axial end of the cylinder body 2. The closer 32 is mounted inside the fixture bracket 31 and can move along the guiding slot 311 between a closed location at which the delivery nozzle receiving opening 312 is closed and an opened location at which the delivery nozzle receiving opening 312 is opened.

Referring to FIG. 11 to FIG. 14, the fixture bracket 31 includes a fixture portion 314, a first limiting protrusion 313, and a guiding portion 315. The fixture bracket 31 is of a hollow structure. The fixture portion 314 is fixed to the first axial end of the cylinder body 2 by using a buckle 3141. An opening 3152 is disposed on each of upper and lower sides of the guiding portion 315. In this way, the guiding portion 315 not only has a function of guiding the closer 32 to move along an inner wall of the fixture bracket 31, but also has a function of dispersing toner in a radial direction. A non-circular hole 3151 is formed in an end wall of the guiding portion 315 away from the delivery nozzle receiving opening 312, and a cross section of the non-circular hole 3151 is non-circular. In other words, the cross section of the non-circular hole 3151 may be encircled by multiple curved line segments or multiple straight line segments or multiple straight line segments and curved line segments. In this embodiment, the cross section of the non-circular hole 3151 is encircled by two parallel straight line segments and two arc line segments between the two parallel straight line segments. When the cross section of the non-circular hole 3151 is non-circular, it may be limited that the closer 32 cannot rotate in a circumferential direction of the fixture bracket 31 relative to the fixture bracket 31, so that when the toner cartridge is in a working state, the closer 32 and the fixture bracket 31 can rotate together with the cylinder body 2. The closer 32 is in clearance fit with the non-circular hole 3151 and moves along the non-circular hole 3151 in an axial direction of the fixture bracket 31.

Figure 13:
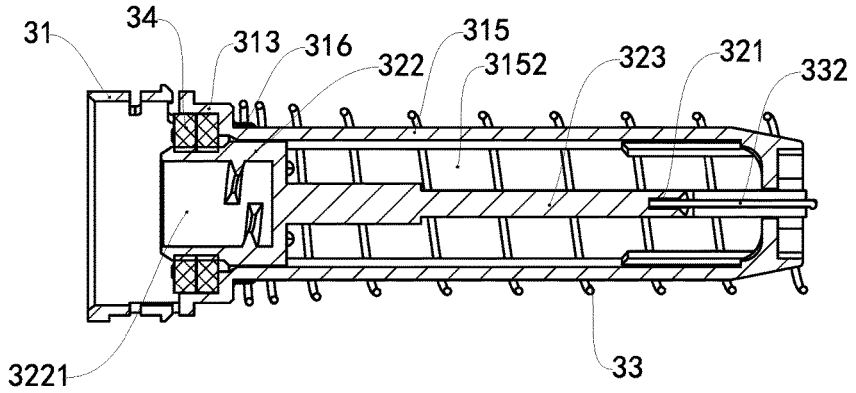
FIG. 13 is a section view of the delivery nozzle receiving device of the toner cartridge according to an embodiment of the present invention.
Figure 14:
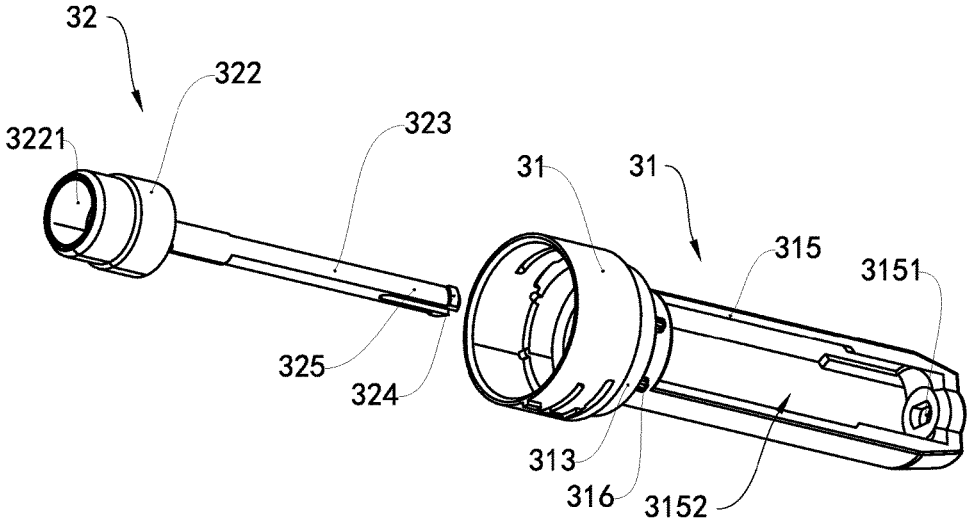
FIG. 14 is an exploded structural view of a closer and a fixture bracket of the toner cartridge according to an embodiment of the present invention.
Figure 15:
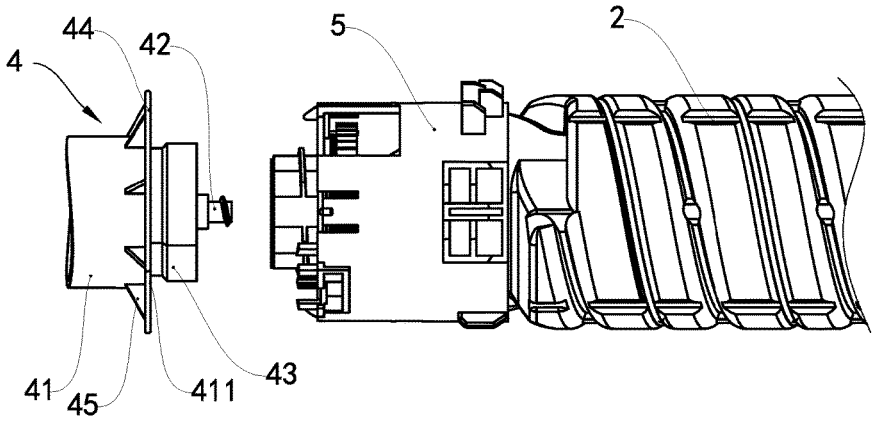
FIG. 15 is an exploded structural view of an outer cover and a cylinder body of the toner cartridge according to an embodiment of the present invention.
Figure 16:
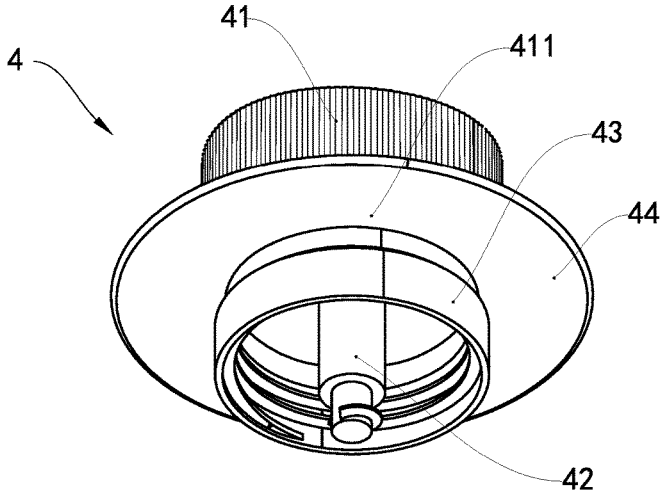
FIG. 16 is a first-angle view of the outer cover of the toner cartridge according to an embodiment of the present invention.
Figure 17:
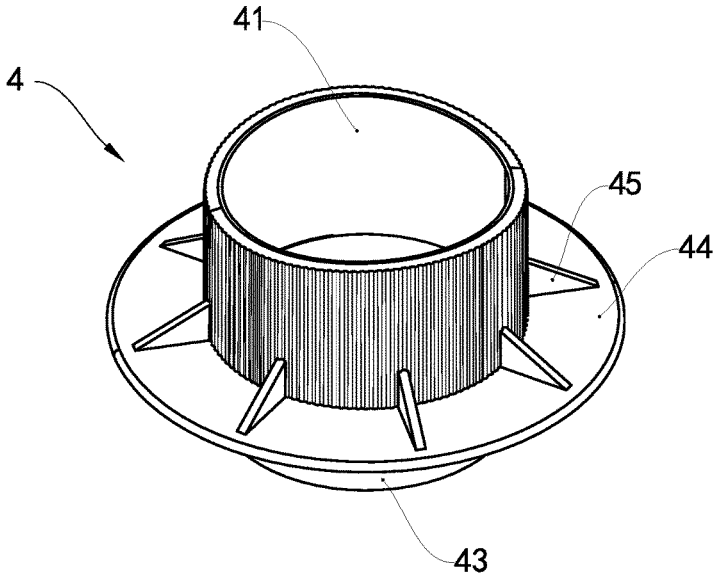
FIG. 17 is a second-angle view of the outer cover of the toner cartridge according to an embodiment of the present invention.

Referring to FIG. 13 and FIG. 14, the closer 32 includes a closing portion 322, a guiding rod 323, and a stopping portion 324. The guiding rod 323 is connected between the closing portion 322 and the stopping portion 324, the closing portion 322 is located at a location close to the delivery nozzle receiving opening 312, and the closing portion 322 is in clearance fit with the inner wall of the fixture bracket 31. An end of the guiding rod 323 close to the stopping portion 324 is separated into a pair of cantilevers 325, the stopping portion 324 is a pair of hooks extending towards the outside of the guiding rod 323, and the two hooks are respectively disposed on axial ends of the cantilevers 325. The stopping portion 324 is disposed, so that the closer 32 can be prevented from being separated from the fixture bracket 31. On the delivery nozzle receiving opening 312, a mounting slot is disposed between the fixture bracket 31 and the closing portion 322, and the seal 34 is mounted inside the mounting slot. Preferably, the seal 34 is leakage prevention foam, to prevent the toner leakage from a gap between the fixture bracket 31 and the closing portion 322.

The elastic element is sleeved outside the fixture bracket 31 and pushes the closer 32 towards the closed location, a first end of the elastic element is limited on an end of the fixture bracket 31 close to the delivery nozzle receiving opening 312, and a second end of the elastic element is connected to an end of the closer 32 away from the delivery nozzle receiving opening 312. Preferably, the elastic element is a tension spring 33. Optionally, the first end of the elastic element may be fixed to the end of the fixture bracket 31 close to the delivery nozzle receiving opening 312, or the first end of the elastic element may be fixed to an end of an inner wall of the cylinder body 2 close to the delivery nozzle receiving opening 312 of the fixture bracket 31.

In this embodiment, the first limiting protrusion 313 is disposed on an outer peripheral wall of the end of the fixture bracket 31 close to the delivery nozzle receiving opening 312 and multiple third limiting protrusions 316 are evenly arranged in a circumferential direction of the outer peripheral wall. Thickness of the first limiting protrusion 313 in a radial direction of the fixture bracket 31 is greater than thickness of the third limiting protrusions 316 in the radial direction of the fixture bracket 31. A second limiting protrusion 23 is disposed on an inner peripheral wall of the cylinder body 2 close to the first axial end of the cylinder body 2. The first limiting protrusion 313, the second limiting protrusion 23, the inner peripheral wall of the cylinder body 2, and the outer peripheral wall of the fixture bracket 31 together encircle a limiting slot 7 (shown in FIG. 6). A first end 331 of the tension spring 33 is sleeved on the third limiting protrusions 316 and is fixed inside the limiting slot 7. A free end 332 on a second end of the tension spring 33 is of a bending structure, the free end 332 extends towards the inside of the tension spring 33 along a central axis of the tension spring 33, a mounting hole 321 extending in an axial direction of the closer 32 is formed at a location on the closer 32 close to the cantilevers 325, and an end portion of the free end 332 is disposed inside the mounting hole 321.

Optionally, a direction of turning of the tension spring 33 is opposite to a direction of turning of the helical protrusion on the cylinder body 2. In a process of rotating together with the fixture bracket 31, the tension spring 33 can convey the developer in a second conveying direction from the delivery nozzle receiving opening 312 to the inner side of the cylinder body 2. Therefore, a toner feeding amount can be reduced in a use process of the tension spring 33, this is applicable to toner having relatively good fluidity, and blocking a toner inlet 901 of the delivery nozzle 90 is prevented. The direction of turning of the tension spring 33 may alternatively be the same as the direction of turning of the helical protrusion on the cylinder body 2. In a process of rotating together with the fixture bracket 31, the tension spring 33 can convey the developer in the first conveying direction from the inner side of the cylinder body 2 to the delivery nozzle receiving opening 312. Therefore, a toner feeding amount can be increased in a use process of the tension spring 33, and this is applicable to toner having relatively poor fluidity. In addition, a size of a screw pitch of the tension spring 33 may be controlled to change a toner feeding amount.

Referring to FIG. 6 and FIG. 15 to FIG. 17, the outer cover 4 is mounted on the first axial end of the cylinder body 2. The outer cover 4 includes an integrally formed cover body 41, a stud 42, and a cylindrical extension portion 43. The cylindrical extension portion 43 is disposed on a side wall 411 of a side of the cover body 41 close to the cylinder body 2, and the cylindrical extension portion 43 is perpendicular to the side wall 411. A thread is disposed on an inner wall of the cylindrical extension portion 43. The first axial end of the cylinder body 2 is located inside the cylindrical extension portion 43, and the cylindrical extension portion 43 is fixed to the cylinder body 2 by using the thread. In addition, because the fixture bracket 31 is fixed inside the cylinder body 2, before the toner cartridge is used, the cover body 4 can be fixed relative to the fixture bracket 31. The stud 42 is perpendicular to the side wall 411 of the cover body 41 and is located at a location corresponding to the closer 32, a thread is disposed on an end of the stud 42 close to the cylinder body 2, a threaded hole 3221 is formed in an outer end portion of the closing portion 322, and the stud 42 is in fit connection to the threaded hole 3221.

Because the fixture bracket 31 and the closer 32 are fixed in the circumferential direction of the fixture bracket 31, in other words, the fixture bracket 31 and the closer 32 cannot rotate relatively in the circumferential direction, when the outer cover 4 is rotated and mounted on the cylinder body 2, the thread on the inner wall of the cylindrical extension portion 43 fits the thread on the outer wall of the first axial end of the cylinder body, and meanwhile, the thread on the stud 42 fits the threaded hole 3221 on the closer 322, so that the closer 32 and the cylinder body 2 can be fixed to the outer cover 4 at the same time, thereby preventing toner leakage caused by the fact that the closer 32 moves towards the inside of the cylinder body 2.

In addition, a brim 44 is disposed on an outer peripheral wall of an end of the side wall 411 of the cover body 41, the brim 44 extends in a radial direction of the cover body 41, a reinforcing rib 45 is further disposed on the outer peripheral wall of the cover body 41, and the reinforcing rib 45 is perpendicular to both the brim 44 and the outer peripheral wall of the cover body 41. An antiskid stripe is further disposed on the outer peripheral wall of the cover body 41, to prevent a difficult mounting and disassembling process caused by skid when the outer cover 4 is disassembled from the cylinder body 2 or the outer cover 4 is mounted on the cylinder body 2.

Figure 8:
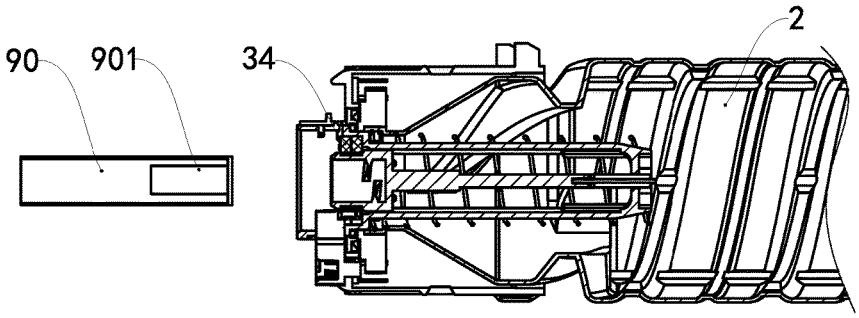
FIG. 8 is a section view before a toner cartridge according to an embodiment of the present invention is connected to an electrophotographic imaging device.
Figure 9:
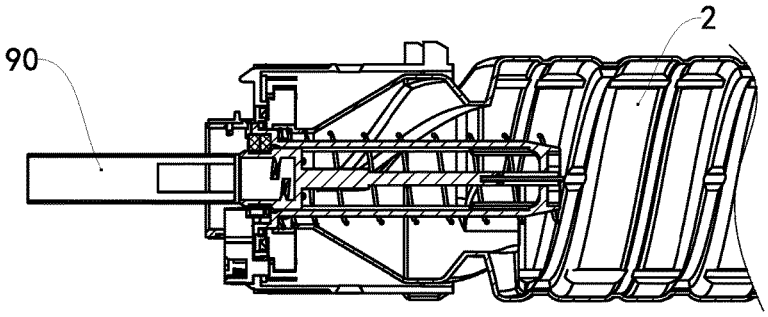
FIG. 9 is a section view in a process of connecting a toner cartridge according to an embodiment of the present invention to an electrophotographic imaging device.
Figure 10:
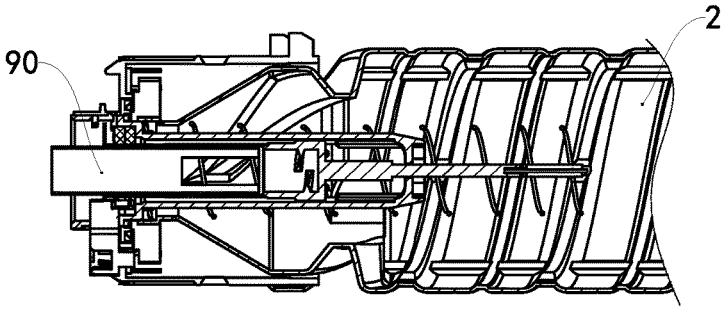
FIG. 10 is a section view after a toner cartridge according to an embodiment of the present invention is connected to an electrophotographic imaging device.
Figure 11:
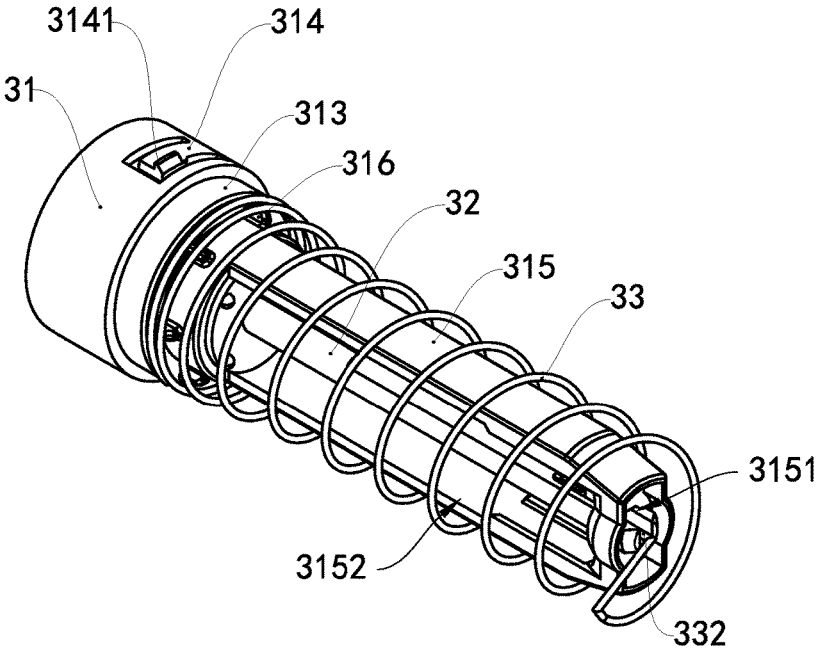
FIG. 11 is a first-angle view of a delivery nozzle receiving device of the toner cartridge according to an embodiment of the present invention.
Figure 12:
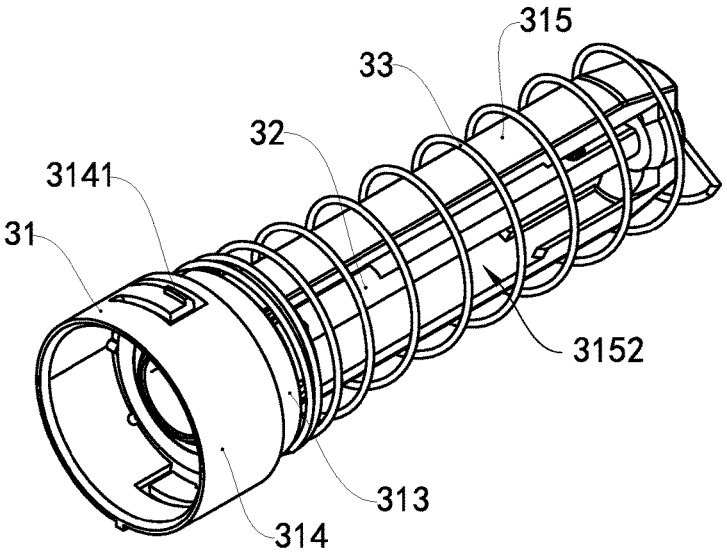
FIG. 12 is a second-angle view of the delivery nozzle receiving device of the toner cartridge according to an embodiment of the present invention.

The following describes, with reference to FIG. 8 to FIG. 10, a process of connecting the delivery nozzle receiving device 3 to the delivery nozzle 90 of the electrophotographic imaging device in a process of mounting the toner cartridge onto the electrophotographic imaging device.

FIG. 8 is a status view before the toner cartridge is connected to the delivery nozzle, FIG. 9 is a status view in a process of connecting the toner cartridge to the delivery nozzle, and FIG. 10 is a status view after the toner cartridge is connected to the delivery nozzle.

Before the toner cartridge is connected to the delivery nozzle 90, under elastic force of the tension spring 33, the closer 32 is pushed to enable the closing portion 322 of the closer 32 to be located at the closed location of the delivery nozzle receiving opening 312 of the fixture bracket 31. In this case, the closer 32 is located at the closed location, and the toner in the cylinder body 2 is not leaked before the toner cartridge is mounted onto the electrophotographic imaging device.

As the toner cartridge is further pushed towards the inside of the electrophotographic imaging device, the delivery nozzle 90 of the electrophotographic imaging device abuts against the closer 32 and exerts force on the closer 32, so that the closer 32 no longer moves. When the cylinder body 2 continues to be pushed forward, the delivery nozzle 90 enters the inside of the cylinder body 2, the closing portion 322 is away from the delivery nozzle receiving opening 312, the closer 32 is located at the opened location, and the toner inside the cylinder body 2 enters the electrophotographic imaging device from the toner inlet 901 of the delivery nozzle 90.

Because one end of the tension spring 33 is connected to the closer 32, as the toner cartridge is further pushed forward, the tension spring 33 is stretched constantly. When the toner in the toner cartridge is used up, and toner is filled into the cylinder body 2, the toner cartridge is pulled outwards, the closer 32 keeps abutting against the delivery nozzle 90 under the elastic force of the tension spring 33, and the toner cartridge continues to be pulled outwards until the closing portion 322 is located at the location of the delivery nozzle receiving opening 312, the closer 32 is at the closed location, and the delivery nozzle 90 is separated from the closer 32.

As can be seen from the foregoing solution, during mounting of the toner cartridge, the closer is aligned with the delivery nozzle of the electrophotographic imaging device, the toner cartridge is pushed forward, the delivery nozzle pushes the closer backwards, the closer moves towards the inside of the toner cartridge relative to the cylinder body, to open the delivery nozzle receiving opening, and the elastic element is stretched under the thrust force of the closer and pushes the closer towards a direction of closing the delivery nozzle receiving opening. When the toner cartridge is taken out from the electrophotographic imaging device, the thrust force exerted by the delivery nozzle on the closer is cancelled, and under elastic restoring force of the elastic element, the closer moves in a direction close to the delivery nozzle receiving opening relative to the cylinder body, to close the delivery nozzle receiving opening. The elastic element can be replaced according to requirements of performance of the toner such as fluidity. In addition, the stud is disposed on the outer cover, so that the sealing performance of the toner cartridge is improved, and leakage of the toner in the cylinder body during transportation is prevented.

Finally, it should be noted that the present invention is not limited to the foregoing embodiments. Changes such as changes of a manner of fixing the tension spring and the fixture bracket and a manner of fixing the tension spring and the closer, a change of the direction of turning of the tension spring, a change of the thread pitch of the tension spring, and a change of the direction of turning of the helical protrusion on the cylinder body shall fall within the protection scope of the claims of the present invention.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

What is claimed is:

1. A toner cartridge, comprising a cylinder body used for accommodating developer and a delivery nozzle receiving device disposed on a first axial end of the cylinder body, wherein the delivery nozzle receiving device comprises:

a fixture bracket, wherein the fixture bracket is fixed to the first axial end of the cylinder body and is located inside the cylinder body, a guiding slot is formed in the fixture bracket along a length direction of the fixture bracket, the guiding slot is communicated with the inside of the cylinder body, and a side of the guiding slot close to the first axial end of the cylinder body is provided with a delivery nozzle receiving opening; and a closer, wherein the closer is mounted inside the fixture bracket and can move along the guiding slot between a closed location at which the delivery nozzle receiving opening is closed and an opened location at which the delivery nozzle receiving opening is opened; and wherein the delivery nozzle receiving device further comprises:

an elastic element, wherein the elastic element is sleeved outside the fixture bracket and pushes the closer towards the closed location, a first end of the elastic element is limited on an end of the fixture bracket close to the delivery nozzle receiving opening, and a second end of the elastic element is connected to an end of the closer away from the delivery nozzle receiving opening;

wherein the elastic element comprises a tension spring, a first end of the tension spring is fixed to the end of the fixture bracket close to the delivery nozzle receiving opening, and a second end of the tension spring is connected to the end of the closer away from the delivery nozzle receiving opening of the cartridge;

wherein a conveying component is disposed on the cylinder body, the conveying component comprising a helical protrusion that projects from an inner peripheral wall of the cylinder body in a helical manner, and the conveying component conveys the developer in a first conveying direction from an inner side of the cylinder body to the side of the delivery nozzle receiving opening;

wherein a direction of turning of the tension spring is opposite to a direction of turning of the helical protrusion, and the tension spring conveys the developer in a second conveying direction from the side of the delivery nozzle receiving opening to the inner side of the cylinder body.

2. The toner cartridge according to claim 1, wherein the toner cartridge further comprises an outer cover, wherein the outer cover is mounted on the first axial end of the cylinder body, the closer is in threaded connection to the outer cover, and the fixture bracket and the closer are fixed in a circumferential direction of the fixture bracket.

3. The toner cartridge according to claim 1, wherein a toner feeding opening is formed in a second axial end of the cylinder body, and a toner feeding opening cover is disposed on the toner feeding opening.

* * * * *